US010992025B2

(12) United States Patent
O'Driscoll et al.

(10) Patent No.: US 10,992,025 B2
(45) Date of Patent: Apr. 27, 2021

(54) ANTENNA WITH EXTENDED RANGE

(71) Applicant: Verily Life Sciences LLC, South San Francisco, CA (US)

(72) Inventors: Stephen O'Driscoll, San Francisco, CA (US); Uei-ming Jow, Mountain View, CA (US)

(73) Assignee: VERILY LIFE SCIENCES LLC, South San Francisco, CA (US)

( * ) Notice: Subject to any disclaimer, the term of this patent is extended or adjusted under 35 U.S.C. 154(b) by 35 days.

(21) Appl. No.: 16/382,874

(22) Filed: Apr. 12, 2019

(65) Prior Publication Data

US 2020/0328499 A1 Oct. 15, 2020

(51) Int. Cl.
*H01Q 1/24* (2006.01)
*H01Q 1/12* (2006.01)
*H01Q 1/22* (2006.01)

(52) U.S. Cl.
CPC ..... *H01Q 1/24* (2013.01); *H01Q 1/125* (2013.01); *H01Q 1/2258* (2013.01)

(58) Field of Classification Search
None
See application file for complete search history.

(56) References Cited

U.S. PATENT DOCUMENTS 6,297,776 B1 10/2001 Pankinaho
6,501,435 B1 * 12/2002 King ..... B65B 15/04 343/795
9,331,384 B2 5/2016 Jenwatanavet et al.
9,819,069 B2 11/2017 Piskun
2004/0239565 A1 12/2004 Brachat
2006/0290572 A1 12/2006 Chan
2009/0121948 A1 * 5/2009 Nysen ..... H01Q 13/10 343/702
2010/0196744 A1 * 8/2010 Tucholski ..... H01M 10/0436 429/7
2011/0275421 A1 11/2011 Wong et al.
2014/0049438 A1 2/2014 Krupa et al.
2014/0071004 A1 3/2014 Jenwatanavet et al.
2014/0168016 A1 6/2014 Bae et al.
2014/0253394 A1 9/2014 Nissinen et al.
2016/0126753 A1 5/2016 Wight et al.
2017/0025743 A1 1/2017 Kim et al.
(Continued)

OTHER PUBLICATIONS

Shete et al., "Design and Optimization of Coplanar Capacitive Coupled Probe Fed MSA Using ANFIS", Wireless and Mobile Technologies 3.1, 2016, 7-12.
(Continued)

*Primary Examiner* — Crystal L Hammond
(74) *Attorney, Agent, or Firm* — Kilpatrick Townsend & Stockton LLP

(57) ABSTRACT

Disclosed herein are techniques for improving the radiation efficiency and coverage range of antennas in wireless devices. According to some embodiments, an antenna includes an antenna feed and a radiator, where signals to be transmitted by the antenna are coupled from the antenna feed to the radiator through distributed and coherent coupling, such that the radiations by the antenna feed and the radiator constructively interfere in a far field to achieve a higher radiation efficiency and an increased coverage range, without increasing the power consumption of the antenna.

20 Claims, 8 Drawing Sheets

(56) References Cited

U.S. PATENT DOCUMENTS

| | | | | |
|---|---|---|---|---|
| 2017/0360623 | A1 | 12/2017 | Christiansen et al. | |
| 2018/0288709 | A1 | 10/2018 | Yao et al. | |
| 2019/0319339 | A1* | 10/2019 | Wen | G04G 21/04 |

OTHER PUBLICATIONS

International Application No. PCT/US2020/026389, International Search Report and Written Opinion, dated Jun. 29, 2020, 18 pages.

* cited by examiner

100

300

ANTENNA WITH EXTENDED RANGE

FIELD

The present disclosure generally relates to wireless communication antennas with improved radiation efficiency and extended coverage range.

BACKGROUND

A wireless transmitter, such as a radio frequency transmitter, generally uses an antenna to radiate radio frequency or microwave signals. One characteristic of an antenna is its coverage range. An antenna with a sufficiently large coverage is generally desired. The coverage range of an antenna may be a function of multiple parameters, including the electromagnetic wave frequency, transmission power, antenna type, location, and ambient environment of the antenna. For example, an antenna for a higher frequency band may have smaller physical dimensions, but the electromagnetic waves radiated by the antenna may have higher loss during propagation and may have low penetration capability, and thus may be significantly attenuated during propagation, resulting in a lower coverage range.

SUMMARY

Techniques disclosed herein relate to improving the radiation efficiency and the coverage range of antennas for wireless communication. For example, a wireless device may include a circuit board, an antenna feed mounted on the circuit board and configured to receive an electrical signal from the circuit board and radiate the electrical signal, and a radiator mounted on the circuit board and adjacent to the antenna feed. The antenna feed may be positioned in proximity to a portion of a perimeter of the radiator to feed the electrical signal to the radiator by distributed coupling along the portion of the perimeter of the radiator. The radiator may be configured to receive the electrical signal from the antenna feed by the distributed coupling and radiate the received electrical signal. In some embodiments, the antenna feed and the radiator may be configured such that the electrical signal radiated by the antenna feed and the electrical signal radiated by the radiator are coherent and constructively interfere in a far field. In some embodiments, the electrical signal in the antenna feed and the electrical signal in the radiator may be phase-aligned on propagation paths of the electrical signal in the antenna feed and the electrical signal in the radiator. In some embodiments, the electrical signal may have a signal frequency higher than 2.4 GHz.

In some embodiments of the wireless device, the antenna feed may extend in a direction along the portion of the perimeter of the radiator. In some embodiments, the antenna feed includes a plurality of distributed feed elements configured to feed the electrical signal to the radiator by the distributed coupling. In some embodiments, the radiator may include an electrode or a case of a battery. In some embodiments, at least one of the radiator or the antenna feed may be raised at a distance above a surface of the circuit board to physically isolate the radiator or the antenna feed from the circuit board. In some embodiments, the radiator may be configured to cause the electrical signal to resonate in the radiator.

In some embodiments, the wireless device may also include an intermediate conductive element positioned between the antenna feed and the radiator. In some embodiments, the wireless device may also include a second radiator, where the antenna feed may be configured to feed the electrical signal to the second radiator by distributed coupling and the second radiator may be configured to radiate the electrical signal. In some embodiments, the antenna feed and the second radiator may be configured such that the electrical signal radiated by the antenna feed and the electrical signal radiated by the second radiator are coherent and constructively interfere in a far field.

In some embodiments, the wireless device may also include a case configured to enclose the circuit board, the antenna feed, and the radiator. The case may include an internal bottom surface, and the circuit board may be separate from the internal bottom surface by a distance (e.g., an air gap). In some embodiments, the case may be configured to be attached to an absorbent article, the wireless device may further include a wetness sensor configured to measure a moisture level in the absorbent article, and the electrical signal may indicate the measured moisture level. In some embodiments, the wireless device may be characterized by a peak spatial-average specific absorption rate averaged over any 1 gram of tissue (defined as a tissue volume in the shape of a cube) less than 1.6 W/kg, such as below about 0.8 W/kg, about 0.4 W/kg, about 0.08 W/kg, about 0.04 W/kg, or lower.

According to certain embodiments, an antenna may include an antenna feed and a radiator. The antenna feed may be configured to receive an electrical signal and radiate the electrical signal. The radiator may be adjacent to the antenna feed and characterized by a perimeter. The antenna feed may be adjacent to a portion of the perimeter of the radiator and may be configured to feed the electrical signal to the radiator by distributed coupling along the portion of the perimeter of the radiator. The radiator may be configured to receive the electrical signal from the antenna feed through the distributed coupling and radiate the received electrical signal. In some embodiments, the antenna feed and the radiator may be configured such that the electrical signal radiated by the antenna feed and the electrical signal radiated by the radiator are coherent and constructively interfere in a far field. In some embodiments, the radiator may include an electrode or a case of a battery. In some embodiments, the electrical signal may have a signal frequency higher than 2.4 GHz.

According to certain embodiments, a method may include receiving, by an antenna feed of an antenna, an electrical signal to be transmitted by the antenna; radiating the electrical signal by the antenna feed; receiving, by a radiator adjacent to the antenna feed and through distributed coupling along at least a portion of a perimeter of the radiator, a portion of the electrical signal radiated by the antenna feed; and radiating, by the radiator, the received portion of the electrical signal. The electrical signal radiated by the antenna feed and the received portion of the electrical signal radiated by the radiator may be coherent and may constructively interfere in a far field. The radiator may include an electrode or a case of a battery.

These illustrative examples are mentioned not to limit or define the scope of this disclosure, but rather to provide examples to aid understanding thereof. Illustrative examples are discussed in the Detailed Description, which provides further description. Advantages offered by various examples may be further understood by examining this specification. This summary is neither intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim. The foregoing, together with other features and examples, will be described in more detail below in the following specification, claims, and accompanying drawings.

BRIEF DESCRIPTION OF THE DRAWINGS

The accompanying drawings, which are incorporated into and constitute a part of this specification, illustrate one or more examples and, together with the description of the examples, serve to explain the principles and implementations of the examples.

FIG. 3A is a perspective view of the example of the wireless device. FIG. 3B is a top view of the example of the wireless device. FIG. 3C is a side view of the example of the wireless device.

Figure 1A:
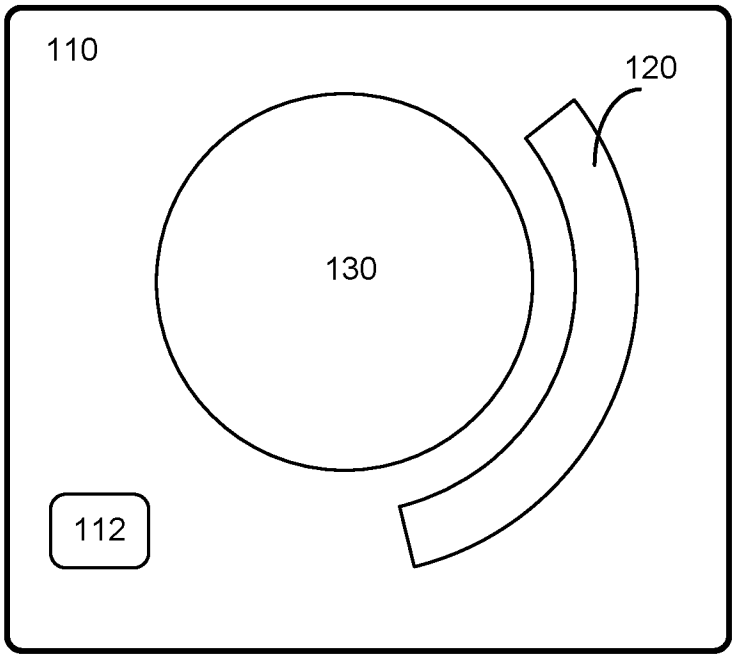
FIG. 1A is a top view of an example of an antenna in a wireless device according to certain embodiments.

The figures depict embodiments of the present disclosure for purposes of illustration only. One skilled in the art will readily recognize from the following description that alternative embodiments of the structures and methods illustrated may be employed without departing from the principles, or benefits touted, of this disclosure.

In the appended figures, similar components and/or features may have the same reference label. Further, various components of the same type may be distinguished by following the reference label by a second label that distinguishes among the similar components. If only the first reference label is used in the specification, the description is applicable to any one of the similar components having the same first reference label irrespective of the second reference label.

DETAILED DESCRIPTION

Techniques disclosed herein relate generally to wireless communication antennas with improved radiation efficiency and extended coverage range. According to some embodiments, an antenna includes a feed and a radiator, where signals to be transmitted by the antenna are coupled from the feed to the radiator through distributed and coherent coupling to achieve coherent radiations by the feed and the radiator. As a result, the radiations by the feed and the radiator may constructively interfere to achieve a higher radiation efficiency and an increased coverage range, without increasing the power consumption of the antenna. Various inventive embodiments are described herein, including systems, modules, devices, components, methods, and the like. Those of ordinary skill in the art will realize that the following description is illustrative only and is not intended to be in any way limiting.

In one illustrative example, an antenna of a wireless transmitter in a wearable device (e.g., a baby monitoring device) includes a signal feeding component and a battery (e.g., a circular battery), where the battery includes an electrode or case that is also used as an antenna radiator and/or a resonator. The signal feeding component is positioned adjacent to and extends in a direction along the perimeter of the battery. The signal feeding component couples a radio frequency (RF) signal to the battery along the perimeter of the battery. The signal feeding component and the battery are configured such that the RF signal propagating in the signal feeding component and the RF signal coupled to the battery are spatially in-phase (i.e., phase-aligned) along the perimeter of the battery. As such, radiations from the signal feeding component and the battery may constructively interfere to increase the radiation efficiency of the antenna, and thus the coverage range of the antenna can be increased without increasing the power consumption of the antenna.

The antennas described herein may be used in any device or system that uses wireless signals for communication, and, in particular, in devices and systems where both a low power consumption and a high coverage range are desired, such as battery-powered mobile devices, wearable devices, baby care devices, medical devices, and the like.

As used herein, two signals are "coherent" in time and space when they have the same frequency and maintain a fixed phase relation (e.g., a zero or a non-zero constant phase offset) between the two signals during propagation. For example, for two coherent signals, the phase of the first signal at any given location on its propagation path and the phase of the second signal at any given location on its propagation path may have a zero or a non-zero constant offset at any given time. In contrast, two signals are non-coherent when they do not have the same frequency or do not maintain a fixed phase relation between the two signals during propagation (e.g., have a random phase offset). When two coherent signals are in-phase at a given location, they may always constructively interfere with each other at the given location, where the amplitude of the combined signal may be the sum of the amplitudes of the two coherent signals. When two coherent signals have opposite phases (i.e., a phase offset of about 180° or $\pi$ rad) at a given location, they may always destructively interfere with each other at the given location to cancel each other out such that the amplitude of the combined signal is the difference between the amplitudes of the two coherent signals. When two non-coherent signals interfere at a given location, the power of the combined signal may be the sum of the powers of the two non-coherent signals.

As used herein, two signals are "spatially in-phase" or "phase-aligned" when the two signals have the same phase at any pair of corresponding locations on their propagation paths during propagation. For example, the two spatially in-phase signals may have a same first phase at a first pair of corresponding locations (e.g., two adjacent locations one on each signal's propagation path), and, after any given time, the two spatially in-phase signals may have the same first phase at a second pair of corresponding locations (e.g., two adjacent locations one on each signal's propagation path), and may have a same second phase at the first pair of corresponding locations.

As used herein, an "electrical length" of a conductor refers to the length of the conductor in term of the phase shift of a signal of a certain frequency after passing through the conductor.

As used herein, a "distributed component" may refer to a component, the physical (and electrical) length of which is significant compared with the wavelength of an electrical signal in the component, and thus the property of the electrical signal propagating in the component may be a function of time and location on the component. Thus, the distributed component can be modeled by multiple discrete components connected together by transmission lines or delay lines. In some embodiments, an electrical component may be considered a distributed component when the delay of an electrical signal by the electrical component is greater than, for example, 10%, 20%, 25%, 50%, 75%, 100%, or higher of the period of the highest frequency component of the electrical signal or the rise time of the electrical signal.

As used herein, the term "distributed coupling" refers to the coupling of electrical signals between two electrical components that are better modeled as spatially distributed components for the electrical signals, and thus the coupling between the two electrical components are better modeled as the coupling between many discrete components.

In the following description, for the purposes of explanation, specific details are set forth in order to provide a thorough understanding of examples of the disclosure. However, it will be apparent that various examples may be practiced without these specific details. For example, devices, systems, structures, assemblies, methods, and other components may be shown as components in block diagram form in order not to obscure the examples in unnecessary detail. In other instances, well-known devices, processes, systems, structures, and techniques may be shown without necessary detail in order to avoid obscuring the examples. The figures and description are not intended to be restrictive. The terms and expressions that have been employed in this disclosure are used as terms of description and not of limitation, and there is no intention in the use of such terms and expressions of excluding any equivalents of the features shown and described or portions thereof. The word "example" is used herein to mean "serving as an example, instance, or illustration." Any embodiment or design described herein as "example" is not necessarily to be construed as preferred or advantageous over other embodiments or designs.

Many devices, such as mobile devices, wearable devices, baby care devices, internet-of-thing devices, and medical devices, use radio frequency or microwave signals for communication with other devices or systems based on various wireless communication standards or protocols, such as cellular communication standards (e.g., 2G, 3G, 4G, or 5G cellular communication standards), Global Positioning System (GPS) standards, Wi-Fi, WiMax, Bluetooth, Bluetooth Low Energy (BLE), ZigBee, and the like. These devices (referred to as wireless devices as they use wireless signals for communication) are often powered by rechargeable or non-rechargeable batteries, which generally have limited capacity. In many applications, it is desirable that a wireless device consumes less power, in order to achieve a longer operation time (or battery life) yet still minimize the size of the battery and the overall size of the device. At the same time, it is desirable that the wireless device can communicate with other devices or systems at greater distances, which may often be achieved by increasing the power of wireless signal to be transmitted by the device. However, increasing the power of the wireless signal to be transmitted without improving the radiation efficiency of the transmitter may increase the power consumption of the wireless device and reduce the battery life. In addition, for wearable devices or portable devices that may be used in close proximity to a user's body during normal operations, increasing the power of the transmitted wireless signal may also increase the body's exposure to radio frequency energy and the specific absorption rate ("SAR"), which indicates the radio frequency energy absorption by the body that is averaged over the whole body or averaged over any 1 gram of tissue (defined as a tissue volume in the shape of a cube).

For example, many baby care devices, such as an absorbent article (e.g., a smart diaper) or other tracking or monitoring device, may include a BLE device that transmits signals in the 2.4 GHz band. BLE is often used in applications where battery life is preferred over data transfer speeds (i.e., data rates). BLE devices generally have a short communication range, such as within a room. Communicating through multiple walls or other obstacles may be difficult for BLE devices. Thus, a receiving device (e.g., a smart phone) may need to be in relatively close proximity (e.g., in a same room or just outside the room) to the device worn by a baby with the baby in a position to maximize range (e.g., without covering the device). This may lead to poor user experience when, for example, the baby is lying face down, is held against a caregiver's chest, or is in a different room from the receiver, because the device may not be able communicate with the receiver. A transmitter with a longer coverage range may need to be used to improve the use experience.

A wireless transmitter generally includes one or more antennas, such as a printed antenna (e.g., a micro-strip or patch antenna) or an antenna array. An antenna may include a feed and a radiator, where the signals to be transmitted may be sent from the feed to the radiator for transmitting to the air or other media. In some antennas, the antenna feed may include a wire or a transmission line with a controlled impedance to convey radio frequency electrical signal into the radiator. In some antennas, the antenna feed may convey radio frequency electrical signal into the radiator through capacitive coupling. However, these antennas may not have a high radiation efficiency to improve both the coverage range and the power efficiency of the transmitter.

According to certain embodiments of the antennas disclosed herein, an antenna feed may convey radio frequency electrical signal into a radiator of the antenna through distributed capacitive coupling along at least a portion of the perimeter of the radiator. The physical dimensions, positions, materials, and other parameters of the antenna feed, radiator, and other components of the antenna can be configured such that the electrical signal propagating in the antenna feed and the electrical signal coupled to and propagating in the radiator are spatially in-phase (i.e., phase-aligned) along the perimeter of the radiator. For example, the phase of the electrical signal in a given location of the radiator may be the same as the phase of the electrical signal in a corresponding location of the antenna feed (e.g., the location closest to the given location of the radiator). As such, radiations from the antenna feed and the radiator may constructively interfere with each other to increase the radiation power and radiation efficiency of the antenna, and thus the coverage range of the antenna. In some embodiments, a battery of the device (e.g., a button or coin cell battery, such as a lithium metal button/coin cell battery) may be used as the radiator and/or resonator to reduce the number of components and the physical dimensions of the antenna, the transmitter, and the device.

Figure 1B:
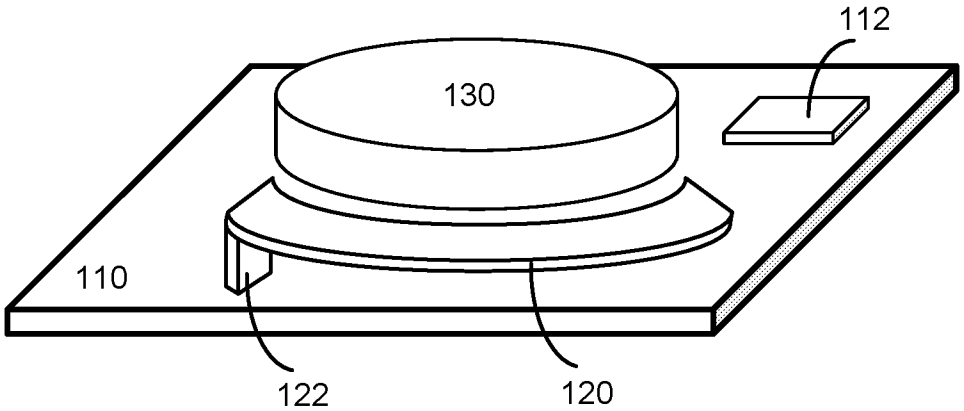
FIG. 1B is a perspective view of the antenna of FIG. 1A according to certain embodiments.

FIGS. 1A and 1B illustrate an example of a wireless device 100 that includes an antenna according to certain embodiments. FIG. 1A is a top view of wireless device 100, and FIG. 1B is a perspective view of wireless device 100. Wireless device 100 may be an electronic device, such as a sensing device that may be attached to or embedded in a wearable item or a mobile device. Wireless device 100 may include a printed circuit board (PCB) 110 that may include one or more conductive layers and one or more dielectric layers. Wireless device 100 may also include a radiator 130 (and/or resonator) for radiating electromagnetic waves into the air. Wireless device 100 may further include an antenna feed 120 that couples electrical signals to radiator 130 for transmission to a receiver through the air. Wireless device 100 may also include one or more other electronic circuits 112 on PCB 110.

In some embodiments, radiator 130 may include a metal patch. In some embodiments, radiator 130 may be a part of a battery that can be mounted or securely held on PCB 110. In some embodiments, the battery may include a button or coin cell battery, such as a lithium, silver, alkaline, or nickel cell battery that includes metal electrodes or a metal case. In some embodiments, radiator 130 may include a positive electrode (i.e., the anode) of the battery that covers the top and side walls of the battery. In some embodiments, radiator 130 may include a part of a compartment or a case that holds a battery.

Electronic circuits 112 may include, for example, capacitors, resistors, inductors, transducers, integrated circuits, and the like. For example, electronic circuits 112 may include a sensor (e.g., a photodetector, pressure sensor, humidity sensor, etc.), a power management device (e.g., a power regulator or converter), an oscillator that generates a carrier signal at, for example, about 2.4 GHz, and a modulator that modulates the carrier signal with data to be transmitted.

Antenna feed 120 may be mounted on PCB 110 and separated from PCB 110 by a certain distance. For example, antenna feed 120 may include a rigid portion 122 that raises other portions of antenna feed 120 above the surface of PCB 110. In some embodiments, a non-conducting spacer may be used to separate antenna feed 120 from PCB 110. As illustrated, antenna feed 120 may extend in a direction along the perimeter of radiator 130. Electrical signals to be transmitted (e.g., carrier signals modulated by data to be transmitted) may be sent from electronic circuits 112 on PCB 110 to antenna feed 120, which may in turn feed the electrical signals to radiator 130, such as the positive electrode (i.e., anode) of a battery that may cover the top and side walls of the battery. Due to the shape of antenna feed 120 and the high frequency (and thus short wavelength) of the carrier signal, the coupling between antenna feed 120 and radiator 130 may be a distributed feeding, where the electrical signal propagating in antenna feed 120 may be gradually transferred to radiator 130 through capacitive coupling as the electrical signal propagates in antenna feed 120 in the direction along the perimeter of radiator 130. In other words, radiator 130 may be a distributed load driven by antenna feed 120.

Figure 2:
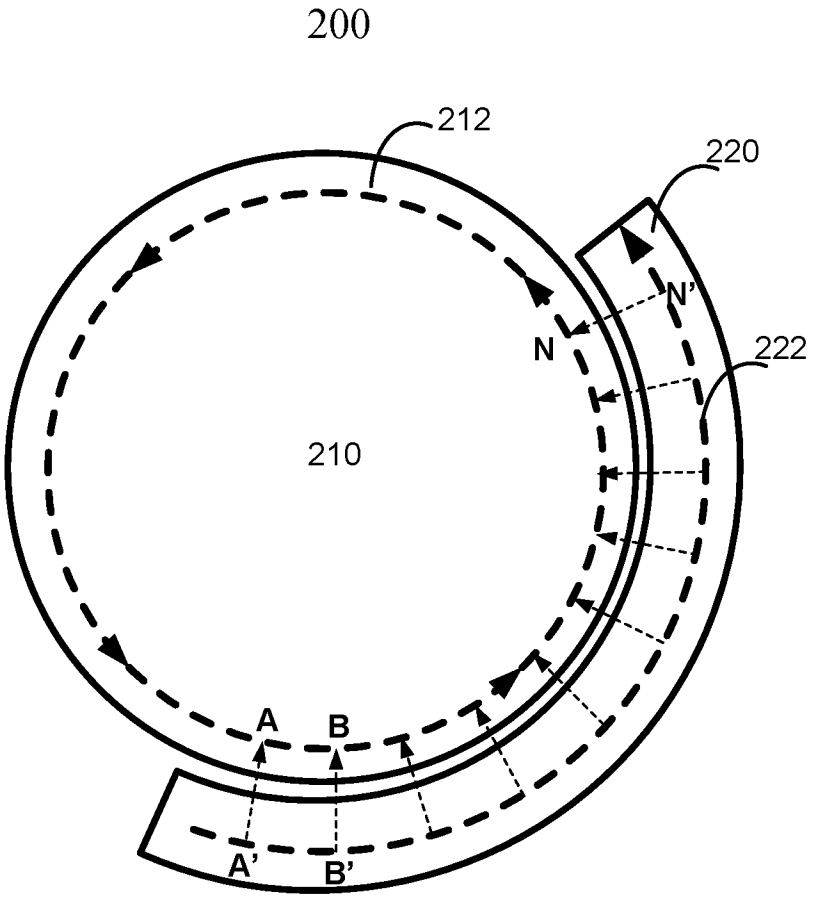
FIG. 2 illustrates distributed coupling between an antenna feed and a radiator in an example of an antenna according to certain embodiments.

FIG. 2 illustrates distributed coupling between an antenna feed 220 and a radiator 210 in an example of an antenna 200 according to certain embodiments. Antenna feed 220 may be an example of antenna feed 120, and radiator 210 may be an example of radiator 130 shown in FIG. 1. As illustrated, radiator 210 may include a metal patch that has, for example, a circular shape. Antenna feed 220 may include a metal conductor. In some embodiments, antenna feed 220 may include a plurality of distributed feed elements (e.g., short conductors). Antenna feed 220 may be positioned adjacent to radiator 210 and may extent in the direction along the perimeter of radiator 210.

An electrical signal 222, such as an RF signal, may be sent to antenna feed 220 and may propagate in antenna feed 220 as shown in FIG. 2. Electrical signal 222 may be partially radiated into the air or another dielectric medium while it propagates within antenna feed 220. The electromagnetic wave radiated into the air may cause the electromagnetic field (and thus the electrical current) at radiator 210 to change, such that at least a portion of electrical signal 222 may be coupled to and received by radiator 210. Radiator 210 may have an electrical length greater than about $\pi/5$, $\pi/4$, $\pi/3$, $\pi/2$, $\pi$, or $2\pi$ rad. Electrical signal 222 may be gradually coupled to radiator 210 as it propagates within antenna feed 220. As such, radiator 210 may act as a distributed load of antenna feed 220. The electrical signal coupled into radiator 210 (e.g., electrical signal 212) may propagate within radiator 210 as shown in FIG. 2 and may at least partially radiated into the air. In some embodiments, electrical signal 212 may resonate within radiator 210, where the resonant frequency may depend on the dimensions of radiator 210.

In addition, the dimensions, materials, and positions of antenna feed 220 and radiator 210 may be tuned such that electrical signal 222 and electrical signal 212 may be synchronized or in-phase in the propagation direction. For example, in some embodiments, the phases of the two electrical signals on corresponding locations of antenna feed 220 and radiator 210 may be the same or may have a fixed delay. More specifically, the phase of electrical signal 212 at point A on radiator 210 and the phase of electrical signal 222 at point A' on antenna feed 220 may be the same (or differ by a phase $\theta$). The phase of electrical signal 212 at point B on radiator 210 and the phase of electrical signal 222 at point B' on antenna feed 220 may be the same (or differ by phase $\theta$). Similarly, the phase of electrical signal 212 at point N on radiator 210 and the phase of electrical signal 222 at point N' on antenna feed 220 may be the same (or differ by phase $\theta$). Therefore, the radiation by radiator 210 and the radiation by antenna feed 220 may be coherent (e.g., spatially in-phase), and thus may constructively interfere with each other to maximize the radiation efficiency and the radiation power in a far filed.

In contrast, in an antenna where the antenna feed is coupled to the radiator physically or capacitively through a single feed point or a small region (compared with the wavelength of the electrical signal to be transmitted), the radiation by the radiator and the radiation by the antenna feed may not be coherent or spatially in-phase, and thus may not always constructively interfere with each other to maximize the radiation efficiency and the radiation power in a far field.

Figure 3B:
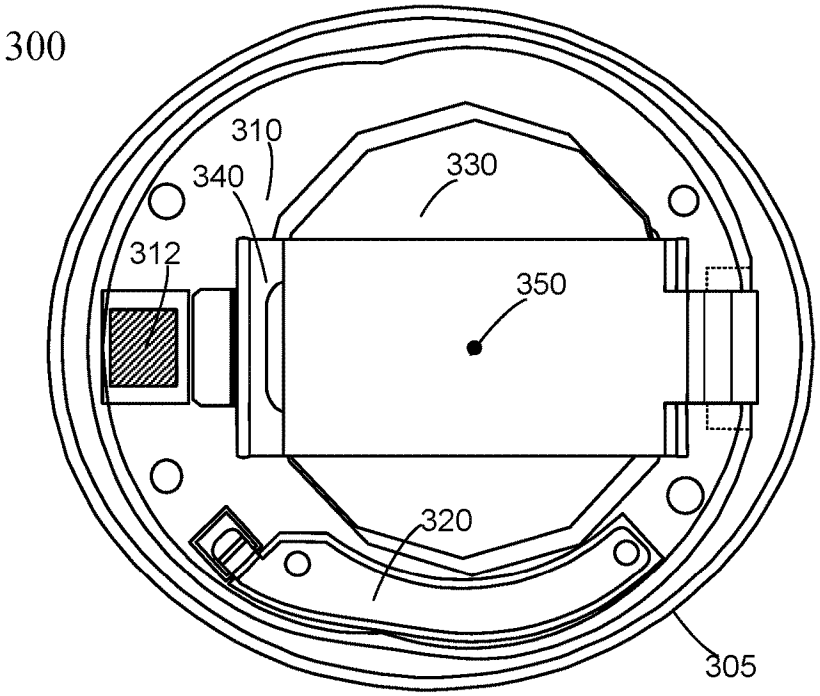
FIGS. 3A-3C illustrate an example of a wireless device including an antenna feed and a battery as an antenna radiator according to certain embodiments.
Figure 3C:
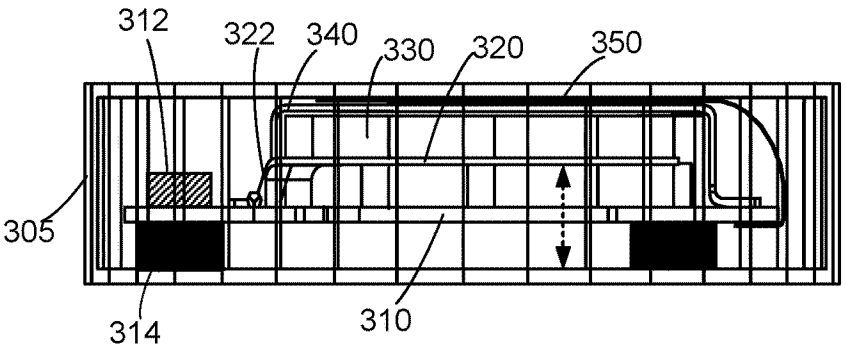
Figure 3A:
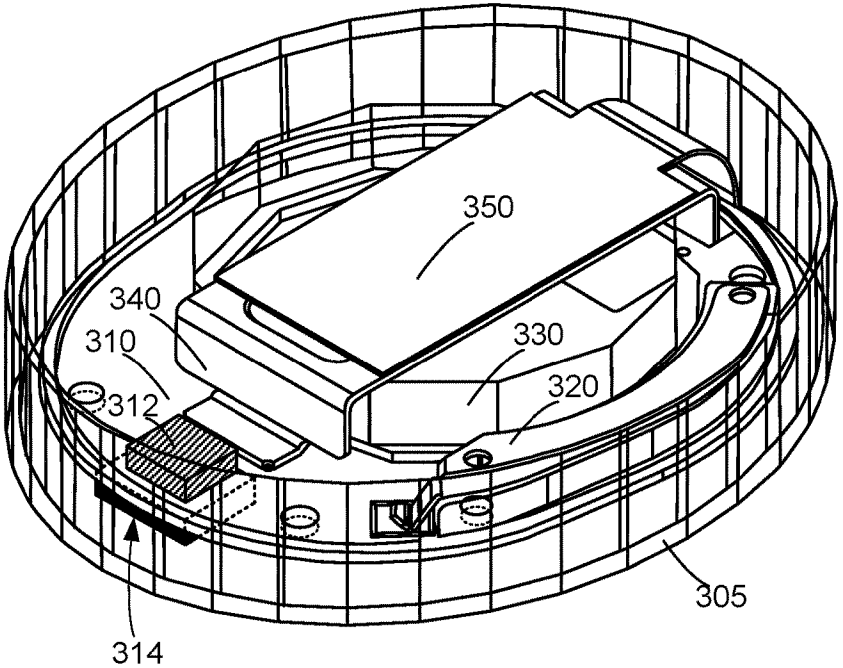

FIGS. 3A-3C illustrate an example of a wireless device 300 including an antenna feed 320 and a battery 330 as an antenna radiator according to certain embodiments. FIG. 3A is a perspective view of wireless device 300. FIG. 3B is a top view of wireless device 300. FIG. 3C is a side view of wireless device 300. In some embodiments, wireless device 300 may include a sensing or monitoring device that can be worn by or attached to a subject. For example, wireless device 300 may be a sensing device that is attached to or embedded in absorbent articles (e.g., diapers, pants, pads) for monitoring the status of the absorbent articles (e.g., if the article has been soiled with urine, feces, or other bodily fluids) and/or persons wearing the absorbent articles. The absorbent articles can be disposable, semi-durable, or durable. The absorbent articles can also comprise a durable component and a disposable component.

As illustrated, wireless device 300 may include a case 305 that holds other components of wireless device 300. Case 305 may be a closed structure of any shape, such as a circle, an oval, a polygon, and the like. Case 305 may include a non-conductive material and/or a conductive material. In some embodiments, case 305 may include some openings for communicating with and/or measuring the ambient environment. The opening may include input ports for various sensors for monitoring the ambient environment, such as the temperature or moisture level of an absorbent article or other wearable devices, or the vital signs (e.g., temperature, pulse rate, blood pressure, or respiration rate) of a person wearing the wearable device.

A PCB 310 may be positioned in case 305. As shown in FIG. 3C, in some embodiments, PCB 310 may be separated from the bottom of case 305 by one or more spacers 314, which may include a non-conductive material. Thus, even if the bottom of case 305 is wet due to the contact with a liquid (e.g., water), PCB 310 may not be in direct contact with the liquid. PCB 310 may include one or more components 312 mounted on or embedded in PCB 310, which may include electrical components, mechanical components, or various types of transducers, such as chemical sensors (e.g., an odor sensor). As described above with respect to electronic circuits 112, component 312 may include, for example, a sensor (e.g., a photodetector, pressure sensor, humidity sensor, thermal sensor, etc.), a power management device (e.g., a power regulator or converter), an oscillator that generates a carrier signal at, for example, about 2.4 to about 2.8 GHz, and a modulator that modulates the carrier signal with data to be transmitted.

An antenna feed 320 may be installed on PCB 310. Antenna feed 320 may include a conductive material. In some embodiments, antenna feed 320 may be connected to PCB 310 through a rigid portion 322, which may raise antenna feed 320 above the top surface of PCB 310. In some embodiments, a space may be used to raise antenna feed 320 and separate it from the top surface of PCB 310. Antenna feed 320 may receive electrical signals to be transmitted to a far field, such as RF signals modulated by data to be sent to a receiver, from a circuit on PCB 310. The data to be sent may indicate, for example, measurement results of the various sensors, such as an alarm signal indicating that the measured moisture level in the wearable device is higher than a threshold level.

A battery 330, such as a button or coin cell battery (e.g., a lithium, silver, alkaline, or nickel cell battery) may be positioned on PCB 310. Battery 330 may include an electrode (e.g., anode) that covers the top and side walls of battery 330. Another electrode (e.g., the cathode) of battery 330 may be in contact with a trace, pad, or another conductor on PCB 310. Battery 330 may be securely held in place on PCB 310 and/or electrically connected to PCB 310 by a first element 340 and/or a second element 350, where first element 340 and second element 350 may be physically and/or electrically connected to PCB 310. For example, the anode of battery 330 may be in physical or electrical contact with first element 340 and/or second element 350. First element 340 and second element 350 may be conductive or non-conductive, and may act as a part of the antenna, such as a portion of the radiator and/or the resonator of the antenna.

As illustrated in FIGS. 3A-3C, antenna feed 320 may extend in the direction along the perimeter of battery 330 and may be positioned close to battery 330 such that the electromagnetic fields generated by the electrical signals in antenna feed 320 may cause electromagnetic field changes and thus electrical current variations in the electrode (e.g., anode) of battery 330. Thus, the electrical signals to be transmitted may be capacitively coupled to battery 330 from antenna feed 320. The electrical signal coupled to and propagate in the electrode of battery 330 may cause electromagnetic radiation from the electrode of battery 330 to air or another medium.

Figure 4B:
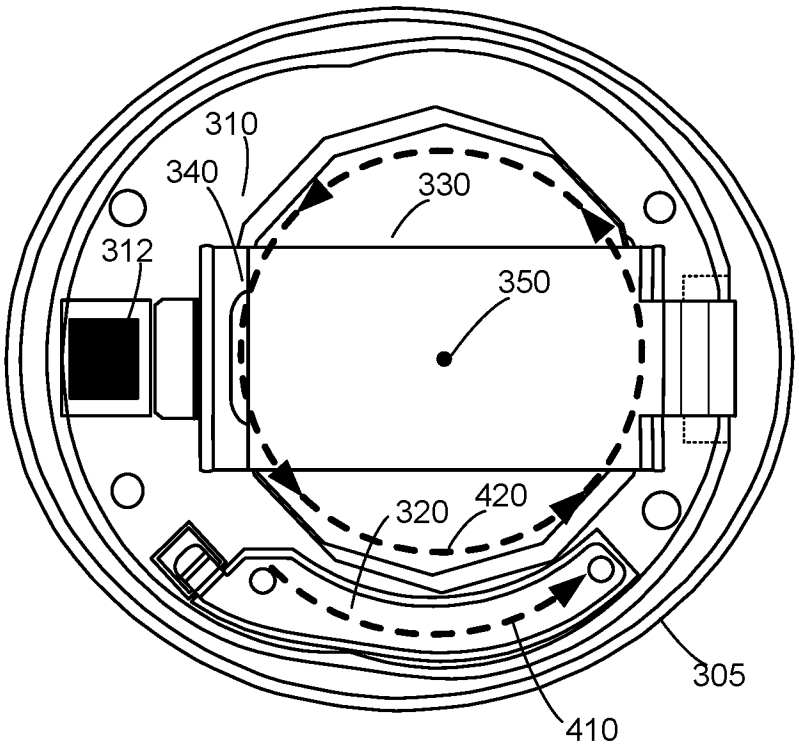
FIG. 4B illustrates coherent radiation by the antenna feed and the radiator in the example of the wireless device of FIG. 4A according to certain embodiments.
Figure 4A:
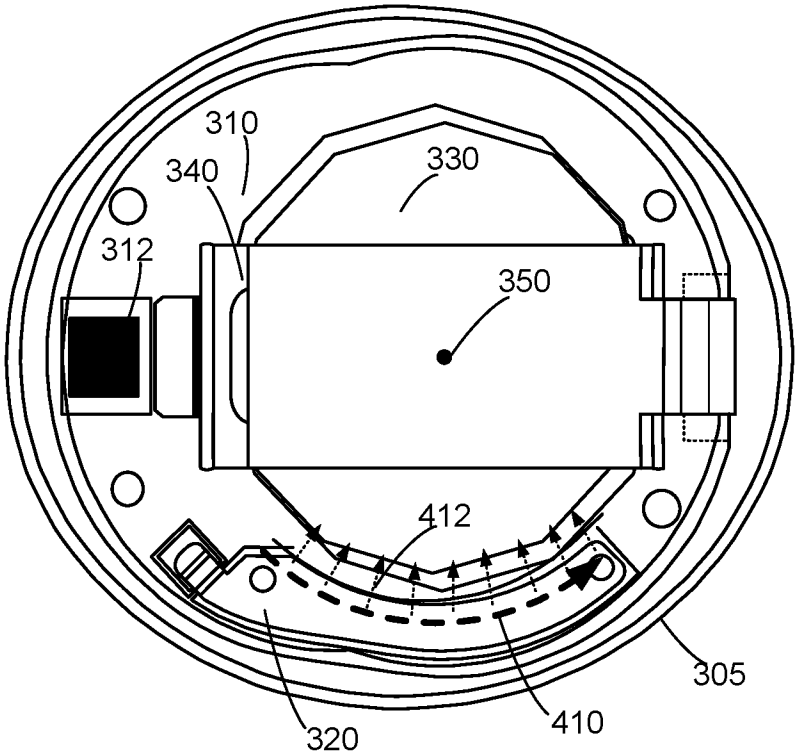
FIG. 4A illustrates distributed coupling between an antenna feed and a radiator in an example of a wireless device according to certain embodiments.

FIG. 4A illustrates distributed coupling between an antenna feed (e.g., antenna feed 320) and a radiator (e.g., anode of battery 330) in an example of a wireless device (e.g., wireless device 300) according to certain embodiments. As described above, an electrical signal 410 may be sent to antenna feed 320 and propagate in antenna feed 320 in the direction as shown in FIG. 4A. The length of antenna feed 320 in the propagation direction of electrical signal 410 may be significant compared with the wavelength of electrical signal 410 and thus would act as multiple distributed components rather a single component. For example, the delay of electrical signal 410 by antenna feed 320 (i.e., the electrical length of antenna feed 320) may be greater than 10%, 20%, 25%, 50%, 75%, 100%, or longer of the period of the highest frequency component of electrical signal 410. Thus, during the propagation, a portion of electrical signal 410 may be coupled to the anode of battery 330 by each of the multiple distributed components as shown by the imaginary lines 412.

In addition, the physical dimensions, materials, positions, and the like of antenna feed 320, the radiator (e.g., anode of battery 330), first element 340, and second element 350 may be tuned such that electrical signal 410 propagating in antenna feed 320 and the electrical signal propagating in the radiator may be spatially in-phase (i.e., phase-aligned) to generate coherent radiation (e.g., electromagnetic field) as described above with respect to FIG. 2. For example, in some embodiments, the propagation speed of electrical signal 410 in antenna feed 320 may be different from (e.g., slightly faster than) the propagation speed of the electrical signal in the radiator (e.g., due to different material permeability and/or permittivity) to maintain the fixed phase relation spatially along the perimeter of the radiator.

FIG. 4B illustrates coherent radiation by antenna feed 320 and the radiator (e.g., anode of battery 330) in the example of the wireless device (e.g., wireless device 300) according to certain embodiments. As illustrated, antenna feed 320 may be adjacent to at least a portion of the perimeter of battery 330, and may be closely coupled to the perimeter of battery 330. Electrical signal 410 propagating in antenna feed 320 and an electrical signal 420 coupled to and propagating in the anode of battery 330 may be coherent (e.g., spatially in-phase) as described above with respect to FIG. 2. For example, electrical signal 410 and electrical signal 420 may have the same phase at a first pair of corresponding locations (e.g., a pair of adjacent locations) one on each electrical signal's propagation path, and, after any given time, may have the same phase at a second pair of corresponding locations (e.g., another pair of adjacent locations) one on each signal's propagation path.

Because electrical signal 410 and electrical signal 420 are coherent, their radiations may be coherent as well. The coherent radiations by antenna feed 320 and battery 330 may constructively interfere to increase the radiation efficiency and power, and thus the coverage range, of the antenna, without increasing the power consumption or size of the wireless device, making more space for the antenna, or using expensive materials (e.g., dielectric materials) or complicated three-dimensional structures. In addition, the peak spatial-average specific adsorption rate (SAR) averaged over any 1 gram of tissue (defined as a tissue volume in the shape of a cube) associated with the absorbent articles may be reduced to a value much lower than about 1.6 W/kg, such as below about 0.8 W/kg, 0.4 W/kg, 0.08 W/kg, 0.04 W/kg, or lower.

Figure 5A:
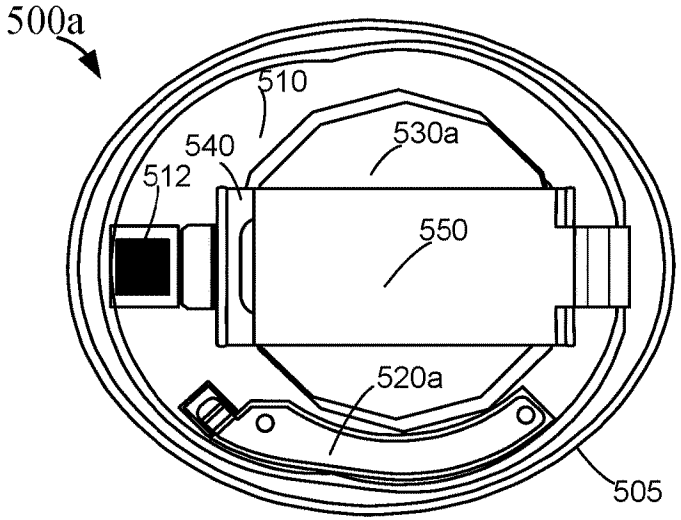
FIG. 5A illustrates an example of an antenna feed in a wireless device according to certain embodiments.

FIG. 5A illustrates an example of an antenna feed 520*a* in a wireless device 500 according to certain embodiments. As wireless device 300, wireless device 500 may include a case 505 that may be similar to case 305, a PCB 510 that may be similar to PCB 310, and one or more components 512 that may be similar to components 312. Wireless device 500 may also include an antenna that may include an antenna feed 520*a* and a radiator 530*a*, which may be an electrode of a battery as described above with respect to FIGS. 3A-3C. In some embodiments, wireless device 500 may also include a first element 540 and a second element 550 that are similar to first element 340 and second element 350, respectively. Antenna feed 520*a* and radiator 530*a* (and, in some embodiments, first element 540 and second element 550) may be co-designed and co-optimized to cause distributed coupling of the electrical signal to be transmitted by the antenna from antenna feed 520*a* to radiator 530*a*, and also to maintain coherency (e.g., spatially in-phase relation) between the electrical signal propagating in antenna feed 520*a* and the electrical signal propagating in radiator 530*a* along the propagation paths. In the example shown in FIG. 5A, antenna feed 520*a* may include a piece of solid conductive material, where the width of antenna feed 520*a* may vary as needed in order to achieve the coherent radiations.

Figure 5B:
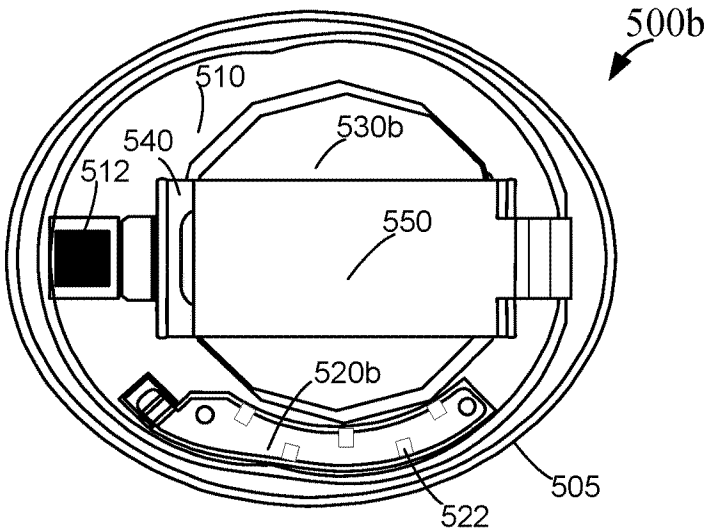
FIG. 5B illustrates an example of an antenna feed in a wireless device according to certain embodiments.

FIG. 5B illustrates an example of an antenna feed 520*b* in a wireless device 500*b* according to certain embodiments. Wireless device 500*b* may be similar to wireless device 500*a*, and may include an antenna that includes an antenna feed 520*b* and a radiator 530*b* that may be configured differently from antenna feed 520*a* and radiator 530*a* to achieve the desired distributed coupling and coherent radiations. For example, as illustrated, antenna feed 520*b* may include one or more cutout or indentation regions 522.

Figure 5C:
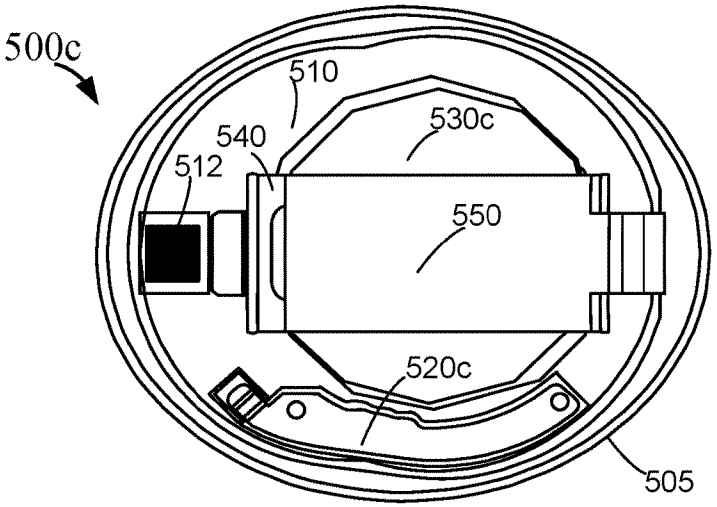
FIG. 5C illustrates an example of an antenna feed in a wireless device according to certain embodiments.

FIG. 5C illustrates an example of an antenna feed 520*c* in a wireless device 500*c* according to certain embodiments. Wireless device 500*c* may be similar to wireless device 500*a*, and may include an antenna that includes an antenna feed 520*c* and a radiator 530*c* that are configured differently from antenna feed 520*a* and radiator 530*a* to achieve the desired distributed coupling and coherent radiations. For example, as illustrated, antenna feed 520*c* may have different widths and/or shape compared with antenna feed 520*a*.

Figure 5D:
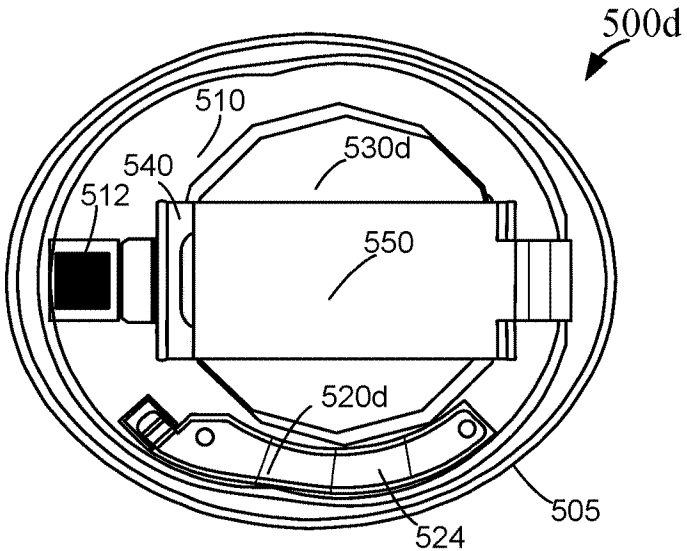
FIG. 5D illustrates an example of an antenna feed in a wireless device according to certain embodiments.

FIG. 5D illustrates an example of an antenna feed 520*d* in a wireless device 500*d* according to certain embodiments. Wireless device 500*d* may be similar to wireless device 500*a*, and may include an antenna that includes an antenna feed 520*d* and a radiator 530*d* that are configured differently from antenna feed 520*a* and radiator 530*a* to achieve the desired distributed coupling and coherent radiations. For example, as illustrated, antenna feed 520*d* may not be flat (e.g., not parallel to PCB 510) and may include one or more tilted sections 524 that may have different tilting angles with respect to PCB 510.

As described above, the antenna radiator of the antenna may be in different shapes, such as a circle, an oval, or a polygon, and may have different physical dimensions. The antenna radiator may be co-designed and co-optimized with the antenna feed to achieve the desired distributed coupling and coherent (e.g., spatially in-phase) radiations.

Figure 6A:
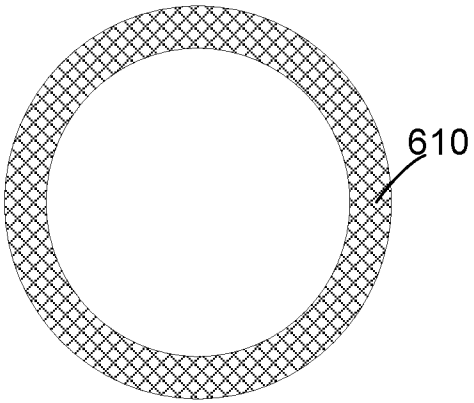
FIG. 6A illustrates an example of an antenna radiator in a shape of a ring according to certain embodiments.
Figure 6B:
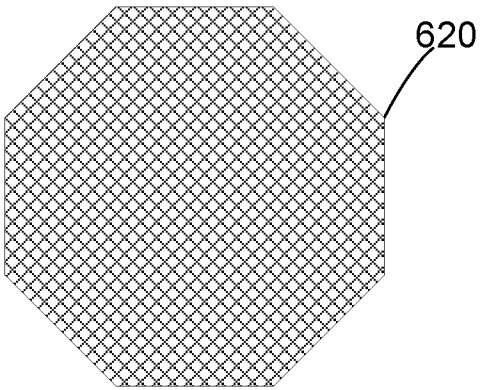
FIG. 6B illustrates an example of an antenna radiator in a shape of a decagon according to certain embodiments.
Figure 6C:
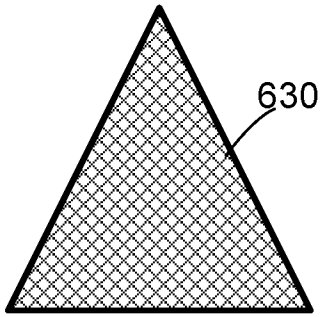
FIG. 6C illustrates an example of an antenna radiator in a shape of a triangle according to certain embodiments.
Figure 6D:
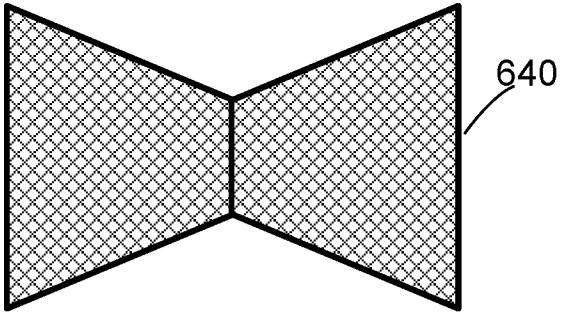
FIG. 6D illustrates an example of an antenna radiator in a shape of a bow tie according to certain embodiments.

FIG. 6A illustrates an example of an antenna radiator 610 in a shape of a ring in an antenna according to certain embodiments. FIG. 6B illustrates an example of an antenna radiator 620 in a shape of an octagon in an antenna according to certain embodiments. FIG. 6C illustrates an example of an antenna radiator 630 in a shape of a triangle in an antenna according to certain embodiments. FIG. 6D illustrates an example of an antenna radiator 640 in a shape of a bow tie in an antenna according to certain embodiments. For any of antenna radiators 610, 620, 630, and 640, a corresponding antenna feed that extends along at least a portion of the perimeter of the antenna radiator may be used to feed the electrical signal to be transmitted to the antenna radiator through distributed and coherent (e.g., spatially in-phase) coupling, such that the radiations by the antenna feed and the antenna radiator may constructively interfere to improve the radiation efficiency of the antenna.

Even though not illustrated in the figures, other structures of the antenna feed and antenna radiator may be used. For example, in some embodiments, an intermediate conductive element may be positioned between the antenna feed and the antenna radiator, where the electrical signal to be transmitted may be coupled from the antenna feed to the intermediate conductive element, and may then be coupled from the intermediate conductive element to the antenna radiator. In some embodiments, the antenna may include more than one radiators. For example, two radiators may be positioned on opposite sides of the antenna feed or may by positioned at different locations along the extension of the antenna feed.

In one example of the antenna disclosed herein, a 400-feet line-of-sight range is achieved for Bluetooth Low Energy (BLE) communication from a wireless device to a smartphone. Some residential obstacles may reduce this line-of-sight range to an effective indoor range of over a few tens of feet. Experiment results have shown robust BLE communication across most paths and through walls and floors in homes. As such, parents or caregivers may be able to communicate with or receive notifications from, for example, absorbent articles (e.g., smart diapers) worn by babies, throughout a family home using their smartphones. In addition, the peak spatial-average SAR associated with the absorbent articles can be lower than about 1.6 W/kg, such as below about 0.8 W/kg, 0.4 W/kg, 0.08 W/kg, 0.04 W/kg, or lower.

Figure 7:
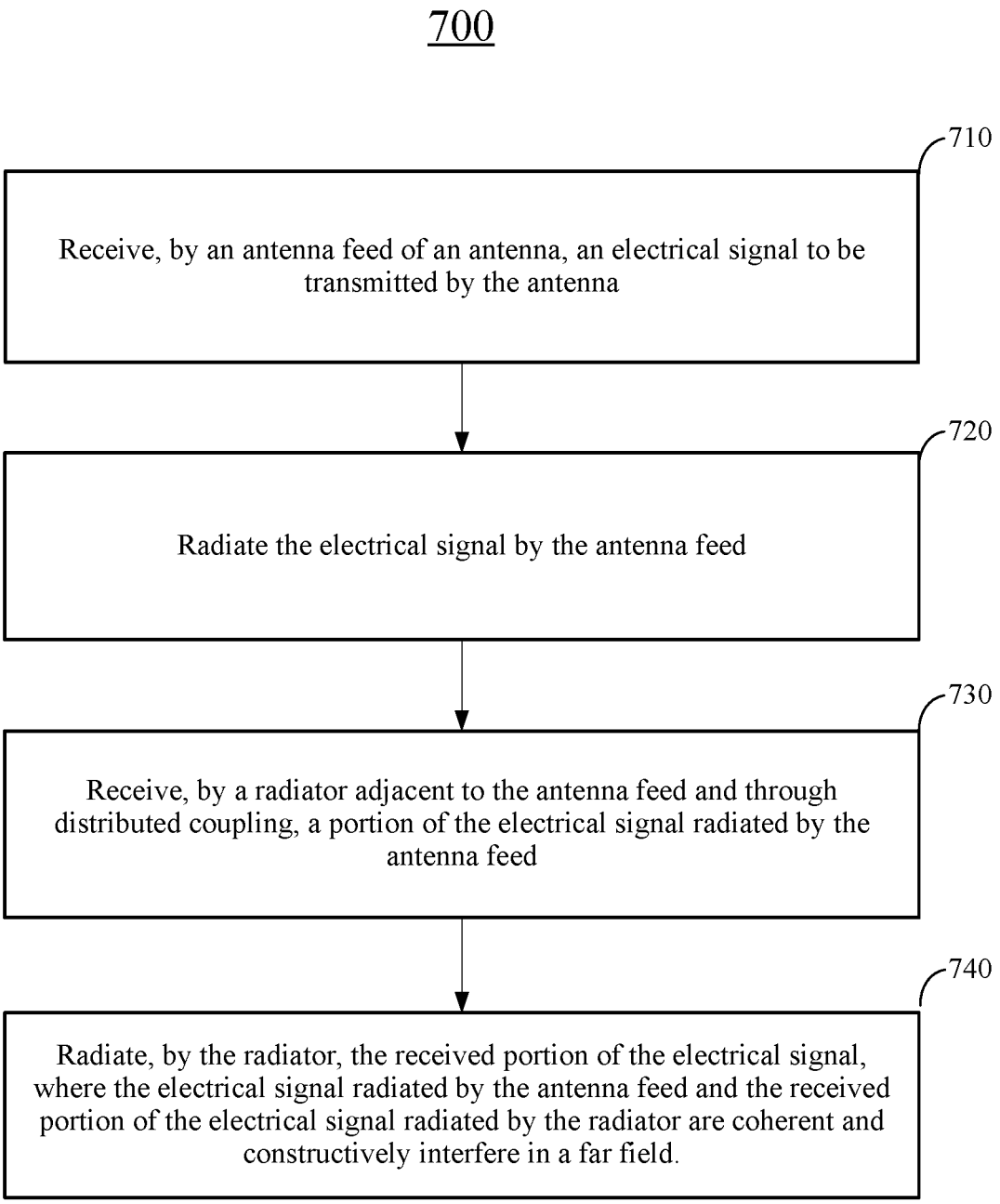
FIG. 7 is a flow chart illustrating an example of a method of transmitting a wireless signal using an antenna according to certain embodiments.

FIG. 7 is a flow chart 700 illustrating an example of a method of transmitting a wireless signal using an antenna according to certain embodiments. The operations described in flow chart 700 are for illustration purposes only and are not intended to be limiting. In various implementations, modifications may be made to flow chart 700 to add additional operations or to omit some operations. The operations described in flow chart 700 may be performed by, for example, the antennas described above with respect to FIGS. 1A-6D.

At block 710, an antenna feed of the antenna may receive an electrical signal to be transmitted by the antenna. As described above, the electrical signal may include an RF signal that includes a carrier signal modulated by data to be transmitted to a receiver. The data to be transmitted may include information detected by a sensor, such as a temperature sensor, a humidity sensor, a chemical sensor, and the like. The carrier signal may have a frequency greater than, for example, 500 MHz, 900 MHz, 2 GHz, 2.4 GHz, or higher. In one example, the electrical signal includes a BLE signal. The electrical signal may be sent to the antenna feed through an impedance-matched transmission line or other conductors.

At block 720, the antenna feed may radiate the electrical signal into air or other surrounding media. The antenna feed may include a conductor that may be better modeled as a distributed component for the electrical signal. For example, the delay of the electrical signal by the antenna feed may be greater than, for example, 10%, 20%, 25%, 50%, 75%, 100%, or higher of the period of the highest frequency component of the electrical signal. In some embodiments, the electrical length of the antenna feed for the electrical signal may be greater than about $\pi/5$, $\pi/4$, $\pi/3$, $\pi/2$, $\pi$, $2\pi$ rad, or longer. The electrical signal may propagate in antenna feed and cause electromagnetic field variations in the air or other surrounding media near the antenna feed.

At block 730, a radiator adjacent to the antenna feed may receive, through distributed coupling, a portion of the electrical signal radiated by the antenna feed. In some embodiments, the radiator includes an electrode or a case of a battery, such as a button or coin cell battery. The radiator may have a perimeter, the length of which may be significant compared with the wavelength of the electrical signal. Thus, the radiator can be modeled as a distributed component as well. The antenna feed may extend along at least a portion of the perimeter of the radiator. Because both the antenna feed and the radiator are distributed components, the coupling of the electrical signal from the antenna feed to the radiator may be distributed coupling along the portion of the perimeter of the radiator as described above with respect to, for example, FIGS. 2 and 4A. The electrical signal coupled to the radiator may propagate in the radiator along the perimeter of the radiator. The electrical signal propagating in the radiator and the electrical signal propagating in the antenna feed may be coherent and may be spatially in-phase or phase-aligned on the propagation paths as described above with respect to, for example, FIGS. 2 and 4B.

At block 740, the radiator may radiate the received portion of the electrical signal into air or other surrounding media. Because the electrical signal propagating in the radiator and the electrical signal propagating in the antenna feed may be coherent and spatially in-phase or phase-aligned on the propagation paths, the electrical signal radiated by the antenna feed and the electrical signal radiated by the radiator may be coherent and may constructively interfere in a far field to increase the radiation efficiency and thus the coverage range of the antenna.

Figure 8:
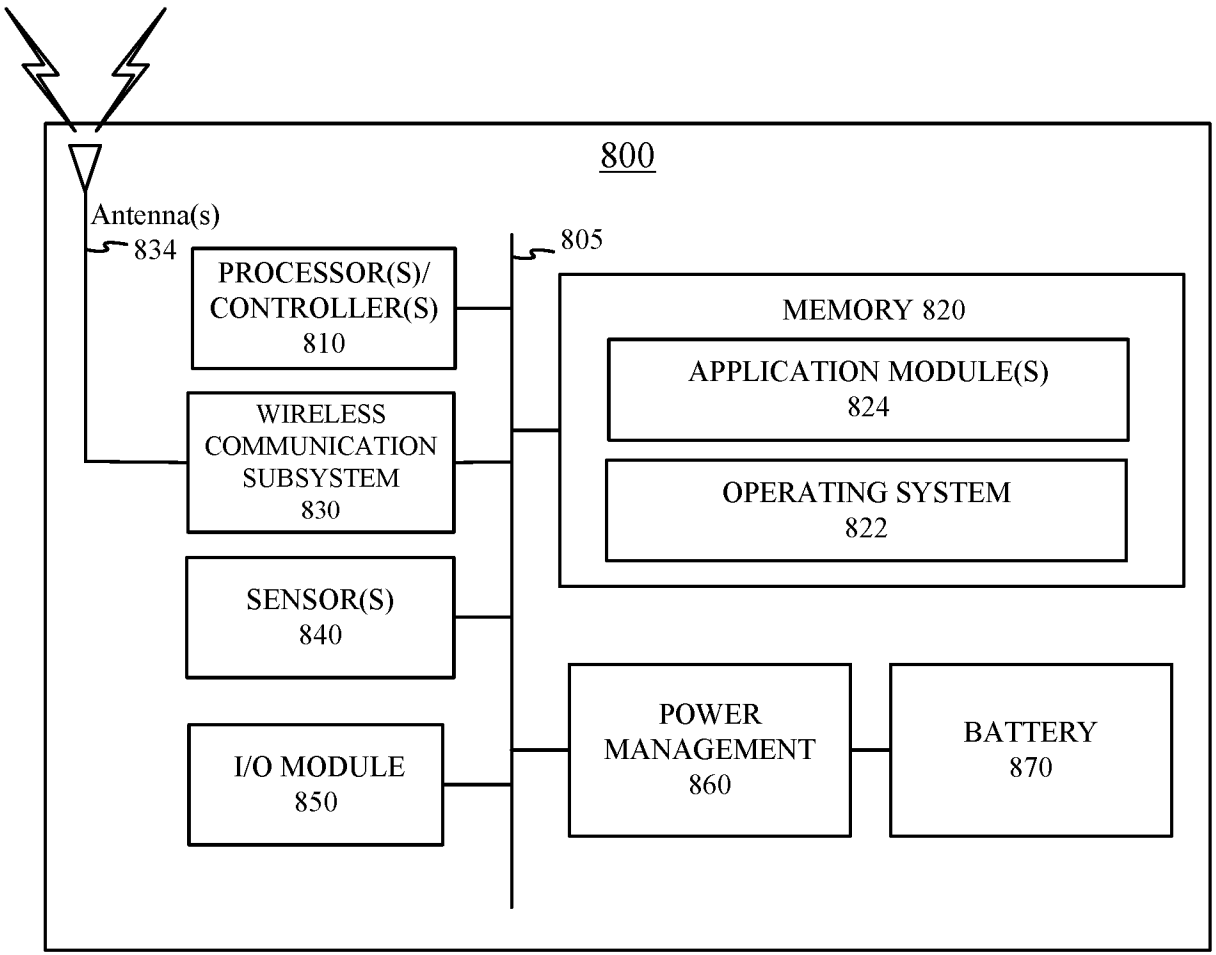
FIG. 8 illustrates an example of an electronic system of a wireless device in which antennas according to certain embodiments may be implemented.

FIG. 8 illustrates an example of an electronic system 800 of a wireless device in which antennas described above according to certain embodiments may be implemented. In this example, electronic system 800 may include one or more processor(s) 810 (or controllers, such as microcontrollers) and a memory 820. Processor(s) 810 may include, for example, an ARM® or MIPS® processor, a microcontroller, or an application specific integrated circuit (ASIC). Processor(s) 810 may be configured to execute instructions for performing operations at a number of components, and can be, for example, a general-purpose processor or microprocessor suitable for implementation within a portable electronic device. Processor(s) 810 may be communicatively coupled with a plurality of components within electronic system 800 through a bus 805. Bus 805 may be any subsystem adapted to transfer data within electronic system 800. Bus 805 may include a plurality of computer buses and additional circuitry to transfer data.

Memory 820 may be coupled to processor(s) 810 directly or through bus 805. In some embodiments, memory 820 may offer both short-term and long-term storage and may be divided into several units. Memory 820 may be volatile, such as static random access memory (SRAM) and/or dynamic random access memory (DRAM), and/or non-volatile, such as read-only memory (ROM), flash memory, and the like. Furthermore, memory 820 may include removable storage devices, such as secure digital (SD) cards. Memory 820 may provide storage of computer-readable instructions, data structures, program modules, and other data for electronic system 800. In some embodiments, memory 820 may be distributed into different hardware modules. A set of instructions and/or code might be stored on memory 820. The instructions might take the form of executable code that may be executable by electronic system 800, and/or might take the form of source and/or installable code, which, upon compilation and/or installation on electronic system 800 (e.g., using any of a variety of generally available compilers, installation programs, compression/decompression utilities, etc.), may take the form of executable code.

In some embodiments, memory 820 may store a plurality of application modules 824, which may include any number of applications. Examples of applications may include applications associated with different sensors to perform different functions. In some embodiments, certain applications or parts of application modules 824 may be executable by other hardware modules. In certain embodiments, memory 820 may additionally include secure memory, which may include additional security controls to prevent copying or other unauthorized access to secure information.

In some embodiments, memory 820 may include a light-weight operating system 822 loaded therein. Operating system 822 may be operable to initiate the execution of the instructions provided by application modules 824 and/or manage other hardware modules as well as interfaces with a wireless communication subsystem 830 which may include one or more wireless transceivers. Operating system 822 may be adapted to perform other operations across the components of electronic system 800 including threading, resource management, data storage control and other similar functionality. Operating system 822 may include various light-weight operating systems, such as operating systems used in internet-of-thing devices.

Wireless communication subsystem 830 may include, for example, an infrared communication device, a wireless communication device and/or chipset (such as a Bluetooth® device, a BLE device, a ZigBee device, an IEEE 802.11 device, a Wi-Fi device, a WiMax device, a near-field communication (NFC) device, etc.), and/or similar communication interfaces. Electronic system 800 may include one or more antennas 834 for wireless communication as part of wireless communication subsystem 830 or as a separate component coupled to any portion of the system. Depending on the desired functionality, wireless communication subsystem 830 may include separate transceivers to communicate with base transceiver stations and other wireless devices and access points, which may include communicating with different data networks and/or network types, such as wireless wide-area networks (WWANs), wireless local area networks (WLANs), or wireless personal area networks (WPANs). A WWAN may be, for example, a WiMax (IEEE 802.16) network. A WLAN may be, for example, an IEEE 802.11x network. A WPAN may be, for example, a Bluetooth network, an IEEE 802.15x network, or some other types of network. The techniques described herein may also be used for any combination of WWAN, WLAN, and/or WPAN. Wireless communications subsystem 830 may permit data to be exchanged with a network, other computer systems, and/or any other devices described herein. Wireless communication subsystem 830 may include a means for transmitting or receiving data, such as various sensor data, using antenna(s) 834. Wireless communication subsystem 830, processor(s) 810, and memory 820 may together comprise at least a part of one or more means for performing some functions disclosed herein.

In some embodiments, electronic system 800 may also include a Standard Positioning Service (SPS) receiver capable of receiving signals from one or more SPS satellites using an SPS antenna. The SPS receiver can extract a position of the portable device, using conventional techniques, from SPS satellite vehicles (SVs) of an SPS system, such as global navigation satellite system (GNSS) (e.g., Global Positioning System (GPS)), Galileo, Glonass, Compass, Quasi-Zenith Satellite System (QZSS) over Japan, Indian Regional Navigational Satellite System (IRNSS) over India, Beidou over China, and/or the like. Moreover, the SPS receiver can use various augmentation systems (e.g., a Satellite Based Augmentation System (SBAS)) that may be associated with or otherwise enabled for use with one or more global and/or regional navigation satellite systems. By way of example but not limitation, an SBAS may include an augmentation system(s) that provides integrity information, differential corrections, etc., such as, e.g., Wide Area Augmentation System (WAAS), European Geostationary Navigation Overlay Service (EGNOS), Multifunctional Satellite Augmentation System (MSAS), GPS Aided Geo Augmented Navigation or GPS and Geo Augmented Navigation system (GAGAN), and/or the like. Thus, as used herein, an SPS system may include any combination of one or more global and/or regional navigation satellite systems and/or augmentation systems, and SPS signals may include SPS, SPS-like, and/or other signals associated with one or more such SPS systems.

In various embodiments, wireless communication subsystem 830 or the SPS receiver may be operable to be powered on, powered off, or in a standby (i.e., sleep) mode. When powered off, circuits in wireless communication subsystem 830 may consume no power. When in a standby mode, only a small portion of wireless communication subsystem 830 may be activated, while the rest of wireless communication subsystem 830 may be deactivated or powered off, and thus the circuit or subsystem may consume a low or minimum level of power.

Embodiments of electronic system 800 may also include one or more sensors 840. Sensors 840 may include, for example, an image sensor, an accelerometer, a pressure sensor, a temperature sensor, a humidity sensor, a proximity sensor, a magnetometer, a gyroscope, an inertial sensor (e.g., a module that includes an accelerometer and a gyroscope), an ambient light sensor, or any other module operable to provide sensory output and/or receive sensory input. Other exemplary sensors include sensors to detect presence and/or amount of bodily solids and fluids captured by an absorbent article. Such sensors are intended to detect urine or feces within an absorbent article worn by a baby/toddler or incontinent adult. There are a number of different types of sensors capable of detecting urine or feces within an absorbent article, including optical sensors, color sensors, capacitive sensors, inductive sensors, and volatile organic compound sensors. These sensors may be implemented using various technologies known to a person skilled in the art. For example, the accelerometer may be implemented using piezoelectric, piezo-resistive, capacitive, or micro electromechanical systems (MEMS) components, and may include a two-axis or multiple-axis accelerometer. In some embodiments, electronic system 800 may include a datalogger, which may record the information detected by the sensors.

Electronic system 800 may include an input/output module 850. Input/output module 850 may include one or more input devices or output devices. Examples of the input devices may include a touch pad, microphone(s), button(s), dial(s), switch(es), a port (e.g., micro-USB port) for connecting to a peripheral device (e.g., a mouse or controller), or any other suitable device for controlling electronic system 800 by a user. In some implementations, input/output module 850 may include an output device, such as a photodiode or a light-emitting diode (LED) that can be used to generate a signaling light beam, such as an alarm signal.

Electronic system 800 may include a power subsystem that may include one or more rechargeable or non-rechargeable batteries 870, such as alkaline batteries, lead-acid batteries, lithium-ion batteries, zinc-carbon batteries, and NiCd or NiMH batteries. The power subsystem may also include one or more power management circuits 860, such as voltage regulators, DC-to-DC converters, wired (e.g., universal serial bus (USB) or micro USB) or wireless (NFC or Qi) charging circuits, energy harvest circuits, and the like.

The devices, systems, modules, components, and methods discussed above are examples only. Various embodiments may omit, substitute, or add various procedures or components as appropriate. Also, features described with respect to certain embodiments may be combined in various other embodiments. Different aspects and elements of the embodiments may be combined in a similar manner. Also, technology evolves and, thus, many of the elements are examples that do not limit the scope of the disclosure to those specific examples.

Specific details are given in the description to provide a thorough understanding of the embodiments. However, embodiments may be practiced without these specific details. For example, well-known circuits, processes, systems, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing various embodiments. Various changes may be made in the function and arrangement of elements without departing from the spirit and scope of the present disclosure.

Also, some embodiments were described as processes depicted as flow diagrams or block diagrams. Although each may describe the operations as a sequential process, many of the operations may be performed in parallel or concurrently. In addition, the order of the operations may be rearranged. A process may have additional steps not included in the figure. Furthermore, embodiments of the methods may be implemented by hardware, software, firmware, middleware, microcode, hardware description languages, or any combination thereof. When implemented in software, firmware, middleware, or microcode, the program code or code segments to perform the associated tasks may be stored in a computer-readable medium such as a storage medium. Processors may perform the associated tasks.

It will be apparent to those skilled in the art that substantial variations may be made in accordance with specific requirements. For example, customized or special-purpose hardware might also be used, and/or particular elements might be implemented in hardware, software (including portable software, such as applets, etc.), or both. Further, connection to other computing devices such as network input/output devices may be employed.

With reference to the appended figures, components that can include memory can include non-transitory machine-readable media. The term "machine-readable medium" and "computer-readable medium" may refer to any storage medium that participates in providing data that causes a machine to operate in a specific fashion. In embodiments provided hereinabove, various machine-readable media might be involved in providing instructions/code to processing units and/or other device(s) for execution. Additionally or alternatively, the machine-readable media might be used to store and/or carry such instructions/code. In many implementations, a computer-readable medium is a physical and/or tangible storage medium. Such a medium may take many forms, including, but not limited to, non-volatile media, volatile media, and transmission media. Common forms of computer-readable media include, for example, magnetic and/or optical media such as compact disk (CD) or digital versatile disk (DVD), punch cards, paper tape, any other physical medium with patterns of holes, a RAM, a programmable read-only memory (PROM), an erasable programmable read-only memory (EPROM), a FLASH-EPROM, any other memory chip or cartridge, a carrier wave as described hereinafter, or any other medium from which a computer can read instructions and/or code. A computer program product may include code and/or machine-executable instructions that may represent a procedure, a function, a subprogram, a program, a routine, an application (App), a subroutine, a module, a software package, a class, or any combination of instructions, data structures, or program statements.

Those of skill in the art will appreciate that information and signals used to communicate the messages described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Terms, "and" and "or" as used herein, may include a variety of meanings that are also expected to depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein may be used to describe any feature, structure, or characteristic in the singular or may be used to describe some combination of features, structures, or characteristics. However, it should be noted that this is merely an illustrative example and claimed subject matter is not limited to this example. Furthermore, the term "at least one of" if used to associate a list, such as A, B, or C, can be interpreted to mean any combination of A, B, and/or C, such as A, AB, AC, BC, AA, ABC, AAB, AABBCCC, etc.

Further, while certain embodiments have been described using a particular combination of hardware and software, it should be recognized that other combinations of hardware and software are also possible. Certain embodiments may be implemented only in hardware, or only in software, or using combinations thereof. In one example, software may be implemented with a computer program product containing computer program code or instructions executable by one or more processors for performing any or all of the steps, operations, or processes described in this disclosure, where the computer program may be stored on a non-transitory computer readable medium. The various processes described herein can be implemented on the same processor or different processors in any combination.

Where devices, systems, components or modules are described as being configured to perform certain operations or functions, such configuration can be accomplished, for example, by designing electronic circuits to perform the operation, by programming programmable electronic circuits (such as microprocessors) to perform the operation such as by executing computer instructions or code, or processors or cores programmed to execute code or instructions stored on a non-transitory memory medium, or any combination thereof. Processes can communicate using a variety of techniques, including, but not limited to, conventional techniques for inter-process communications, and different pairs of processes may use different techniques, or the same pair of processes may use different techniques at different times.

The specification and drawings are, accordingly, to be regarded in an illustrative rather than a restrictive sense. It will, however, be evident that additions, subtractions, deletions, and other modifications and changes may be made thereunto without departing from the broader spirit and scope as set forth in the claims. Thus, although specific embodiments have been described, these are not intended to be limiting. Various modifications and equivalents are within the scope of the following claims.

What is claimed is:

1. A wireless device comprising:

a circuit board;

an antenna feed mounted on the circuit board and configured to receive an electrical signal from the circuit board and radiate the electrical signal; and a radiator mounted on the circuit board and adjacent to the antenna feed, the radiator characterized by a perimeter, wherein the antenna feed is positioned in proximity to a portion of the perimeter of the radiator to feed the electrical signal to the radiator by distributed coupling along the portion of the perimeter of the radiator; and wherein the radiator is configured to receive the electrical signal from the antenna feed by the distributed coupling and radiate the received electrical signal.

2. The wireless device of claim 1, wherein the antenna feed and the radiator are configured such that the electrical signal radiated by the antenna feed and the electrical signal radiated by the radiator are coherent and constructively interfere in a far field.

3. The wireless device of claim 2, wherein the electrical signal in the antenna feed and the electrical signal in the radiator are phase-aligned on propagation paths of the electrical signal in the antenna feed and the electrical signal in the radiator.

4. The wireless device of claim 1, wherein the antenna feed extends in a direction along the portion of the perimeter of the radiator.

5. The wireless device of claim 1, wherein the antenna feed includes a plurality of distributed feed elements configured to feed the electrical signal to the radiator by the distributed coupling.

6. The wireless device of claim 1, wherein the radiator includes an electrode or a case of a battery.

7. The wireless device of claim 1, wherein at least one of the radiator or the antenna feed is raised at a distance above a surface of the circuit board to physically isolate the radiator or the antenna feed from the circuit board.

8. The wireless device of claim 1, wherein the electrical signal is characterized by a signal frequency higher than 2.4 GHz.

9. The wireless device of claim 1, wherein the radiator is configured to cause the electrical signal to resonate in the radiator.

10. The wireless device of claim 1, further comprising an intermediate conductive element positioned between the antenna feed and the radiator.

11. The wireless device of claim 1, further comprising a second radiator, wherein:

the antenna feed is configured to feed the electrical signal to the second radiator by distributed coupling; and the second radiator is configured to radiate the electrical signal.

12. The wireless device of claim 11, wherein the antenna feed and the second radiator are configured such that the electrical signal radiated by the antenna feed and the electrical signal radiated by the second radiator are coherent and constructively interfere in a far field.

13. The wireless device of claim 1, further comprising a case configured to enclose the circuit board, the antenna feed, and the radiator, wherein:

the case includes an internal bottom surface; and the circuit board is separate from the internal bottom surface by a distance.

14. The wireless device of claim 13, wherein:

the case is configured to be attached to an absorbent article;

the wireless device further comprises a wetness sensor configured to measure a moisture level in the absorbent article; and the electrical signal indicates the measured moisture level.

15. The wireless device of claim 1, wherein the wireless device is characterized by a peak spatial-average specific absorption rate averaged over any 1 gram of tissue less than 1.6 W/kg.

16. An antenna comprising:

an antenna feed configured to receive an electrical signal and radiate the electrical signal; and a radiator adjacent to the antenna feed and characterized by a perimeter, wherein the antenna feed is adjacent to a portion of the perimeter of the radiator and is configured to feed the electrical signal to the radiator by distributed coupling along the portion of the perimeter of the radiator; and wherein the radiator is configured to receive the electrical signal from the antenna feed through the distributed coupling and radiate the received electrical signal.

17. The antenna of claim 16, wherein the antenna feed and the radiator are configured such that the electrical signal radiated by the antenna feed and the electrical signal radiated by the radiator are coherent and constructively interfere in a far field.

18. The antenna of claim 16, wherein the radiator includes an electrode or a case of a battery.

19. A method comprising:

receiving, by an antenna feed of an antenna, an electrical signal to be transmitted by the antenna;

radiating the electrical signal by the antenna feed;

receiving, by a radiator adjacent to the antenna feed and through distributed coupling along at least a portion of a perimeter of the radiator, a portion of the electrical signal radiated by the antenna feed; and radiating, by the radiator, the received portion of the electrical signal, wherein the electrical signal radiated by the antenna feed and the received portion of the electrical signal radiated by the radiator are coherent and constructively interfere in a far field.

20. The method of claim 19, wherein the radiator includes an electrode or a case of a battery.

* * * * *